US007401974B2

(12) United States Patent
Himmelsbach

(10) Patent No.: US 7,401,974 B2
(45) Date of Patent: Jul. 22, 2008

(54) AGITATOR WITH FINNED AGITATOR BLADE END

(75) Inventor: Werner Himmelsbach, Rheinfelden (DE)

(73) Assignee: EKATO Rühr- und Mischtechnik GmbH, Schopfheim (DE)

( * ) Notice: Subject to any disclaimer, the term of this patent is extended or adjusted under 35 U.S.C. 154(b) by 0 days.

(21) Appl. No.: 11/746,209

(22) Filed: May 9, 2007

(65) Prior Publication Data

US 2007/0268779 A1 Nov. 22, 2007

(30) Foreign Application Priority Data

May 9, 2006 (DE) ..... 20 2006 007 423 U

(51) Int. Cl.
*B01F 7/22* (2006.01)

(52) U.S. Cl. ..... 366/330.3; 366/330.5

(58) Field of Classification Search ... 366/330.1–330.7, 366/270; 416/90 R, 91–92, 179, 223 R, 228, 416/232–233, 235, 236 R
See application file for complete search history.

(56) References Cited

U.S. PATENT DOCUMENTS

| | | | | | |
|---|---|---|---|---|---|
| 24,508 | A * | 6/1859 | Vergne | 416/236 R |
| 170,937 | A * | 12/1875 | Cook et al. | 416/200 R |
| 262,681 | A * | 8/1882 | Maringer | 416/236 R |
| 695,389 | A * | 3/1902 | Hammond | 416/175 |
| 725,877 | A * | 4/1903 | Rommeney | 68/135 |
| 971,409 | A * | 9/1910 | Roggenbuck | 416/237 |
| 1,244,786 | A * | 10/1917 | Seymour | 416/236 R |
| 1,597,175 | A * | 8/1926 | Boening | 416/235 |
| 1,955,929 | A * | 4/1934 | Mueller | 415/221 |
| 2,014,032 | A * | 9/1935 | Sharpe et al. | 416/228 |
| 2,426,742 | A * | 9/1947 | Pawlowski | 416/189 |
| 3,166,303 | A * | 1/1965 | Chapman | 366/129 |
| 3,171,495 | A * | 3/1965 | Puckett | 416/228 |
| 4,222,710 | A * | 9/1980 | Katagiri et al. | 416/236 A |
| 4,265,596 | A * | 5/1981 | Katagiri et al. | 416/236 A |
| 4,606,103 | A * | 8/1986 | Koehl et al. | 29/889.21 |
| 4,662,823 | A * | 5/1987 | Cooke | 416/23 |
| 4,721,394 | A * | 1/1988 | Casto et al. | 366/343 |
| 4,722,608 | A * | 2/1988 | Salzman et al. | 366/330.5 |
| 4,802,771 | A * | 2/1989 | Weetman | 366/270 |
| 5,046,245 | A * | 9/1991 | Weetman et al. | 29/889.7 |
| 5,152,606 | A * | 10/1992 | Borraccia et al. | 366/331 |
| 5,158,434 | A * | 10/1992 | Weetman | 416/201 A |
| 5,326,168 | A * | 7/1994 | Miura | 366/343 |
| 5,344,235 | A * | 9/1994 | Weetman et al. | 366/270 |
| 5,525,269 | A * | 6/1996 | Connolly et al. | 261/93 |
| 5,595,475 | A * | 1/1997 | Weiss et al. | 416/223 R |
| 6,334,705 | B1 * | 1/2002 | Weetman | 366/330.1 |
| 6,352,408 | B1 * | 3/2002 | Kilian | 416/191 |
| 6,752,595 | B2 * | 6/2004 | Murakami | 416/87 |
| 6,866,482 | B2 * | 3/2005 | Han et al. | 416/195 |

(Continued)

*Primary Examiner*—Charles E Cooley
(74) *Attorney, Agent, or Firm*—Henry M. Feiereisen; Ursula B. Day

(57) ABSTRACT

An agitator includes a hub for attachment to an agitator shaft, and at least two agitator blades which are connected to the hub and extend in a radial direction for rotation about an axis, with the agitator blade angled in relation to the axis. Each agitator blade has a free end, with a fin being provided in an area of the free end of the agitator blade and extending in a substantial parallel relationship to a direction of the axis away from the agitator shaft.

13 Claims, 1 Drawing Sheet

U.S. PATENT DOCUMENTS

| | | | | |
|---|---|---|---|---|
| 6,893,223 | B2 * | 5/2005 | Roberts | 416/210 R |
| 7,296,925 | B2 * | 11/2007 | Himmelsbach et al. | 366/330.3 |
| 2003/0118446 | A1 * | 6/2003 | Han et al. | 416/228 |
| 2003/0123973 | A1 * | 7/2003 | Murakami | 415/4.1 |
| 2006/0187744 | A1 * | 8/2006 | Parker | 366/129 |
| 2006/0187750 | A1 * | 8/2006 | Aldrich et al. | 366/270 |
| 2007/0002686 | A1 * | 1/2007 | Gigas et al. | 366/330.1 |
| 2007/0002687 | A1 * | 1/2007 | Gigas et al. | 366/330.1 |
| 2007/0003415 | A1 * | 1/2007 | Gigas et al. | 416/232 |
| 2007/0268779 | A1 * | 11/2007 | Himmelsbach | 366/330.3 |

* cited by examiner

AGITATOR WITH FINNED AGITATOR BLADE END

CROSS-REFERENCES TO RELATED APPLICATIONS

This application claims the priority of German Patent Application, Serial No.20 2006 007 423.6, filed May 9, 2006, pursuant to 35 U.S.C. 119(a)-(d), the content of which is incorporated herein by reference in its entirety as if fully set forth herein.

BACKGROUND OF THE INVENTION

The present invention relates, in general, to an agitator intended in particular for agitating, mixing, or suspending fluids or solids in fluids.

Nothing in the following discussion of the state of the art is to be construed as an admission of prior art.

Agitators typically have a hub for securement of the agitator to a lower end of an agitator shaft, and at least two agitator blades which are mounted on one side to the hub in spaced-apart radial direction, for example via respective struts, and angled in relation to the rotation plane. This type of agitator suffers shortcomings because turbulent radial forces are caused during agitation, so that the agitator shaft for attachment of the agitator has to be configured of relatively great diameter. As a consequence, production of agitator shafts is relatively complex and expensive.

It would therefore be desirable and advantageous to provide an improved agitator to obviate prior art shortcomings and to eliminate or at least minimize the adverse effect of turbulent radial forces caused during agitation.

SUMMARY OF THE INVENTION

According to one aspect of the present invention, an agitator includes a hub for attachment to an agitator shaft, at least two agitator blades connected to the hub and extending in a radial direction for rotation about an axis, with the agitator blades being angled in relation to the axis, wherein each agitator blade has a free end, and a fin provided in an area of the free end of the agitator blade and extending in a substantial parallel relationship to a direction of the axis away from the agitator shaft.

The present invention resolves prior art problems by providing the agitator with fins in the area of the free ends of the respective agitator blades, with the fins extending in parallel relationship to the axial direction in a direction away from the agitator shaft. The fins realize a damping of the turbulent radial forces caused during agitation. As a result, the agitator shaft can be made of smaller diameter for support of the agitator and thus can be made less expensive.

According to another feature of the present invention, the fin may be constructed in a radial direction in the form of a circular arc. The fin may have a first fin portion, which adjoins the agitator blade and extends in a parallel relationship to the axis, and a radial second fin portion, which adjoins the first fin portion.

According to another feature of the present invention, the agitator blades may be mounted to the hub by associated struts which extend outwards from the hub in radial direction. Suitably, the struts may each has a rod-shaped configuration.

According to another feature of the present invention, the agitator blade may have the shape of a tetragon which is defined by a first side which forms a continuation of an attachment area of the agitator blade to the agitator shaft or strut, a second side which extends at an angle of about 90° from an attachment-area-distal end of the first side to define the free end of the agitator blade, a third side which adjoins the second side and extends at an angle of greater than 90°, and a fourth side which adjoins the third side and extends at an angle of greater than 90°, said fourth side ending at the attachment area or strut at a distance to the hub and positioned in opposition to an attachment area side or strut side which is extended by the first side of the tetragon.

According to another feature of the present invention, the agitator blade may be arched in tangential section in a direction away from the agitator shaft.

According to another feature of the present invention, the first fin portion may be mounted substantially along an entire length of the second side of the tetragon to the agitator blade in a direction away from the agitator shaft, and the second fin portion may extend beyond the length of the second side.

According to another feature of the present invention, the fin may describe a circle defined by a fin diameter, and the agitator blade has an outer perimeter which may describe a circle defined by a blade diameter, wherein a ratio of the fin diameter to the blade diameter may range from about 0.5 to 0.98, preferably up to 1.0.

An agitator according to the invention is preferably used for homogenizing and suspending. The provision of fins results in a damping of turbulent radial forces. This allows construction of agitator shafts of smaller diameter. The fins focus an axial volume stream. The efficiency of the used agitator increases so that application thereof for effecting suspension in large tanks is especially suitable.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 2:
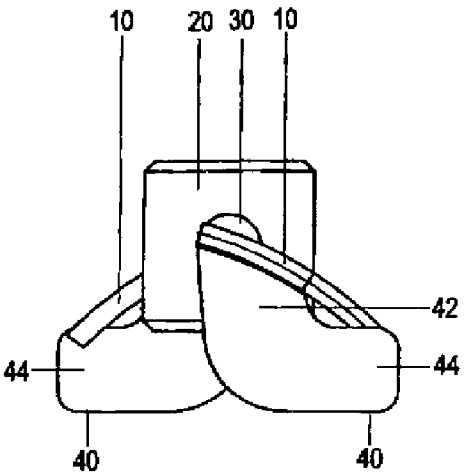
FIG. 2 is a 90° rotated side view of the agitator of FIG. 1.

Throughout all the Figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 1:
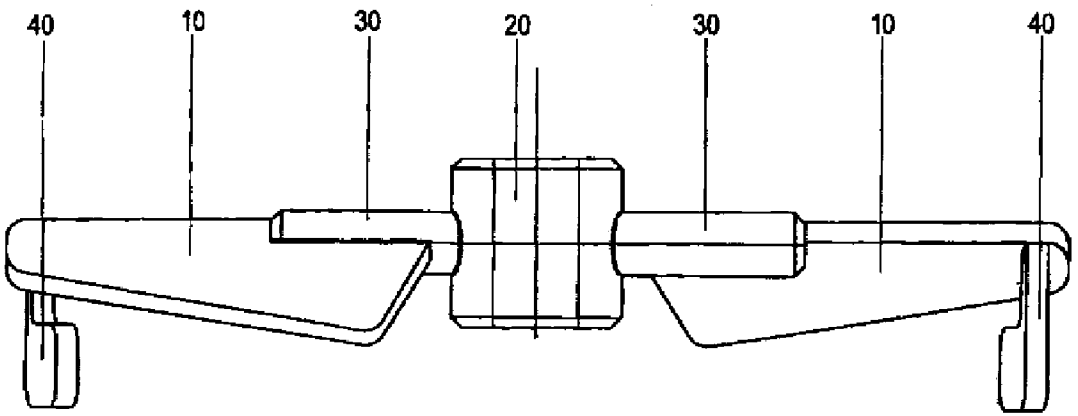
FIG. 1 is a side view of an agitator according to the present invention embodiment.

Turning now to the drawing, and in particular to FIG. 1, there is shown a side view of an agitator according to the present invention, intended in particular for agitating, mixing, or suspending fluids or solids in fluids. The agitator includes a hub 20 via which the agitator can be attached axially to an unillustrated agitator shaft. Struts 30 are attached in the illustrated embodiment to the hub 20, and agitator blades 10 are attached to the struts 30.

FIG. 1 shows two agitator blades 10. It is, of course, also possible to provide several agitator blades 10 which are suitably provided in equal spaced-art relationship on the hub 20 in radial direction. When the agitator blades 10 are attached by the struts 30 to the hub 20, the number of agitator blades 10 is, of course, the same as the number of struts 30.

The respective struts 30 are configured in particular rod-shaped and project outwards from the hub 20 in radial direction. The agitator blades 10 are attached at an angle to the rotation axis on the hub 20, for example on the struts 30. It can further be seen that the agitator blades 10 are arched in tangential section in a direction away from the unillustrated agitator shaft.

Fins 40 are provided in the area of the free ends of the respective agitator blades 10 in parallel relationship to the axial direction, in a direction away from the agitator shaft 10. The fins 40 are each configured as a circular arc in radial direction. The diameter of the circle described by the fins 40 defines in relation to the diameter of the circle described by the outer perimeter of the agitator blades 10 preferably a ratio of about 0.92. Of course, other positions of the fins are conceivable as well. The afore-stated positioning of the fins 40 represents, however, an optimum configuration as far as agitation and fabrication are concerned. As a result of the configuration of the fins 40 in the shape of a circular arc, flow resistance is very slight during movement of the agitator.

FIG. 2 shows a 90° rotated side view of the agitator shown in FIG. 1, for agitating liquids or the like. As can be clearly seen in this FIG. 2, the fins 40 have each a fin portion 42 which adjoins the agitator blade 10 in parallel relationship to the axis, and a radial fin portion 44 which adjoins the first fin portion 42.

Figure 3:
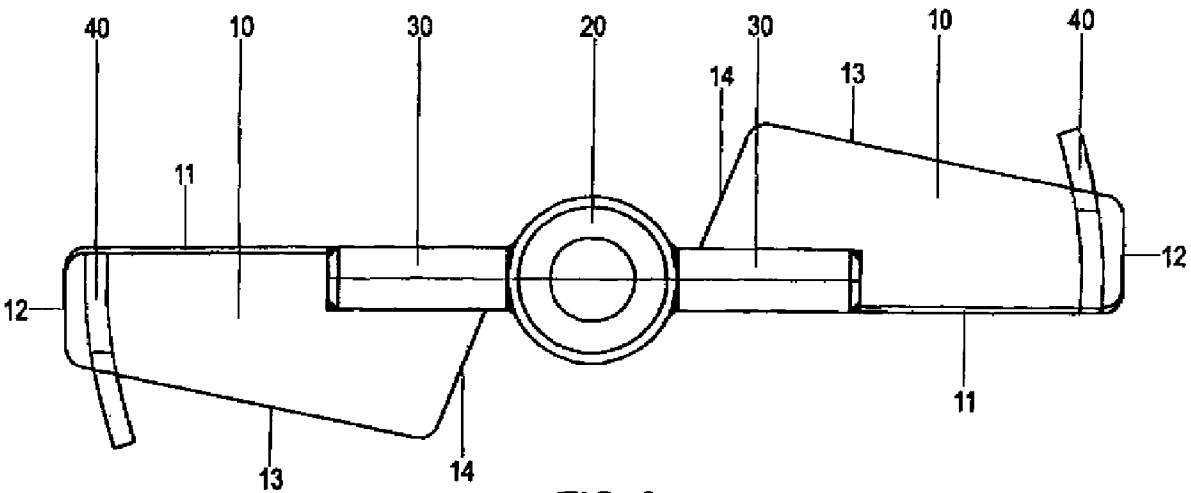
FIG. 3 a top view of the agitator.

FIG. 3 shows a top view of the agitator shown in FIGS. 1 and 2 to more clearly illustrate the configuration of the agitator blades 10. Each agitator blade 10 has, in top view, the shape of a tetragon, with a first side 11 of the tetragon forming a continuation of one side of the attachment area, for example the rod-shaped strut 30, which first side is adjoined by a second side 12 disposed at the free end of the agitator blade 10 and extending at an angle of about 90°, which second side is adjoined by a third side 13 extending at an angle of greater than 90°, which third side is adjoined by a fourth side 14 extending at an angle of greater than 90° and ending on the side of the attachment area, for example the strut 30, at a distance to the hub 20, which fourth side opposes the side of the attachment area, for example the strut 30, which side continues the first side 11 of the tetragon.

FIG. 3 further clearly shows that the first fin portion 42 is mounted, almost along the entire length of the second side 12 of the agitator blade 10, to the agitator blade 10 in a direction away from the agitator shaft, and the second fin portion 44 extends preferably beyond the length of the second side 12 of the agitator blade 10.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. An agitator, comprising:

a hub for attachment to an agitator shaft;

at least two agitator blades connected to the hub and extending in a radial direction for rotation about an axis, said agitator blades being angled in relation to the axis, each said agitator blade having a free end; and a fin provided in an area of the free end of the agitator blade and extending in a substantial parallel relationship to a direction of the axis away from the agitator shaft, wherein the agitator blade has the shape of a tetragon which is defined by a first side which forms a continuation of an attachment area of the agitator blade to the agitator shaft, a second side which extends at an angle of about 90° from an attachment-area-distal end of the first side to define the free end of the agitator blade, a third side which adjoins the second side and extends at an angle of greater than 90°, and a fourth side which adjoins the third side and extends at an angle of greater than 90°, said fourth side ending at the attachment area at a distance to the hub and positioned in opposition to an attachment area side which is extended by the first side of the tetragon.

2. The agitator of claim 1, further comprising more than two agitator blades arranged about the hub at a same spaced-apart relationship.

3. The agitator of claim 1, for agitating, mixing, or suspending fluids or solids in fluids.

4. The agitator of claim 1, wherein the fin is constructed in a radial direction in the form of a circular arc.

5. The agitator of claim 1, wherein the fin has a first fin portion, which adjoins the agitator blade and extends in a parallel relationship to the axis, and a radial second fin portion, which adjoins the first fin portion.

6. The agitator of claim 1, further comprising a strut for mounting the agitator blade to the hub, said strut projecting outwards from the hub in the radial direction.

7. The agitator of claim 6, wherein the strut is rod-shaped.

8. The agitator of claim 1, wherein the attachment area is formed by a strut for mounting the agitator blade to the hub.

9. The agitator of claim 1, wherein the agitator blade is arched in tangential section in a direction away from the agitator shaft.

10. The agitator of claim 1, wherein the fin has a first fin portion, which adjoins the agitator blade and extends in a parallel relationship to the axis, and a radial second fin portion, which adjoins the first fin portion, said first fin portion being attached substantially along an entire length of the second side of the tetragon to the agitator blade in a direction away from the agitator shaft, and said second fin portion extending beyond the length of the second side.

11. The agitator of claim 1, wherein the fin describes a circle defined by a fin diameter, and the agitator blade has an outer perimeter which describes a circle defined by a blade diameter, wherein a ratio of the fin diameter to the blade diameter is about 0.5 to 1.0.

12. The agitator of claim 11, wherein the ratio of the fin diameter to the blade diameter is about 0.5 to 0.98.

13. The agitator of claim 11, wherein the ratio of the fin diameter to the blade diameter is about 0.92.

* * * * *